US011315699B2

(12) United States Patent
Hamill et al.

(10) Patent No.: US 11,315,699 B2
(45) Date of Patent: Apr. 26, 2022

(54) COMPOSITION OF MATTER COMPRISING A RADIOISOTOPE COMPOSITION

(71) Applicant: Siemens Medical Solutions USA, Inc., Malvern, PA (US)

(72) Inventors: James J. Hamill, Knoxville, TN (US); Stefan B. Siegel, Knoxville, TN (US); Charles Russell Buchanan, Knoxville, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 286 days.

(21) Appl. No.: 16/217,103

(22) Filed: Dec. 12, 2018

(65) Prior Publication Data

US 2020/0027619 A1 Jan. 23, 2020

Related U.S. Application Data

(62) Division of application No. 12/887,933, filed on Sep. 22, 2010, now Pat. No. 10,186,337.

(51) Int. Cl.
*G21G 1/06* (2006.01)
*G21G 1/00* (2006.01)

(52) U.S. Cl.
CPC ..... *G21G 1/06* (2013.01); *G21G 2001/0094* (2013.01)

(58) Field of Classification Search
CPC ..... G21G 1/06; G21G 2001/0094
USPC ..... 376/158, 189
See application file for complete search history.

(56) References Cited

U.S. PATENT DOCUMENTS

| | | | | |
|---|---|---|---|---|
| 2,161,985 | A | 6/1939 | Szilard | |
| 2,206,634 | A | 7/1940 | Enrico et al. | |
| 2,859,095 | A | 11/1957 | Manning et al. | |
| 3,686,503 | A | 8/1972 | Givens et al. | |
| 5,208,165 | A * | 5/1993 | Law | G21C 17/0225 376/245 |
| 5,409,677 | A * | 4/1995 | Zinn | G21G 1/10 376/189 |
| 5,572,560 | A * | 11/1996 | Brown | G21C 3/328 376/435 |
| 6,011,825 | A | 1/2000 | Welch et al. | |
| 6,678,344 | B2 | 1/2004 | O'Leary et al. | |
| 6,925,137 | B1 | 8/2005 | Forman | |
| 7,430,902 | B2 * | 10/2008 | Seeman | G21C 17/00 73/150 R |
| 10,804,000 | B2 | 10/2020 | Nilsson et al. | |
| 2007/0016176 | A1 | 1/2007 | Boutoussov et al. | |

FOREIGN PATENT DOCUMENTS

GB 1349750 4/1974

OTHER PUBLICATIONS

Verma, "Neutron Activation Analysis." Atomic and Nuclear Analytical Methods: XRF, Mössbauer, XPS, NAA and B63Ion-Beam Spectroscopic Techniques (2007): 243-268. (Year: 2007).*

(Continued)

*Primary Examiner* — Jack W Keith
*Assistant Examiner* — Daniel Wasil

(57) ABSTRACT

Disclosed are a method and apparatus for making a radioisotope and a composition of matter including the radioisotope. The radioisotope is made by exposing a material to neutrons from a portable neutron source.

3 Claims, 2 Drawing Sheets

(56) References Cited

OTHER PUBLICATIONS

Sundararao, "Decay Characteristics Of Some Shortlived Radionuclides Produced By Activation Using 252Cf Source", CONF-760436, vol. 2 (1976). (Year: 1976).*
Mannhart, "Measurement and evaluation of integral data in the Cf-252 neutron field", In Nuclear Data for Science and Technology, pp. 429-435, Springer, Dordrecht, 1983. (Year: 1983).*
Smith, "Molecular imaging with copper-64", Journal of inorganic biochemistry 98, No. 11 (2004): 1874-1901. (Year: 2004).*
Gadalla, "Impacts of Cooling Water Quality on Operational Safety of Water Cooled Reactor", Eleventh International Water Technology Conference (2007). (Year: 2007).*
Lin, "Optimum coolant chemistry in BWRs", The 4th International Topical Meeting on Nuclear Thermal Hydraulics, Operations and Safety (1994). (Year: 1994).*
Chen, "On the interaction between fuel crud and water chemistry in nuclear power plants", 2000. (Year: 2000).*
Sekine, "Application of Nuclear Recoil to Radioisotope Enrichment of Copper-64: Feasibility of Simplified Chemical Processing of Water-Soluble Copper Phthalocyanine", journal of nuclear science and technology 23, No. 12 (1986): 1064-1068. (Year: 1986).*
Takagi, "Preliminary research on isolation and removal of long-lived radionuclides in reactor coolant by ion exchange resin", Journal of Nuclear Science and Technology 11, No. 8 (1974): 326-333. (Year: 1974).*
Sen, "Role of heavy water in biological sciences with an emphasis on thermostabilization of vaccines", Expert review of vaccines 8, No. 11 (2009): 1587-1602. (Year: 2009).
Matsuura : "Isotope effect of retention value between64Cu and66Cu in neutron-irradiated copper phthalocyanine"; Journal of Radioanalytical and Nuclear Chemistry 134; No. 2; 1989: pp. 311-316.
Hawthorne: "New horizons for therapy based on the boron neutron capture reaction"; Molecular medicine today 4; No. 4 (1998); pp. 174-181.
Ex parte James J. Hamill, Stefan B. Siegel, and Charles Russell Buchanan, decision of the Patent Trial and Appeal Board, U.S. Appl. No. 12/887,933, Appeal No. 2017-010160, 8 pages, dated Aug. 14, 2018.
Chen, J.H. et al; "Cation Self-Diffusion in Chalcopyrite and Pyrite"; Metallurgical Transactions B; vol. 6B; pp. 331-339, Jun. 1975.
Preparation of a Practically Carrier-Free Radioactive Copper Preparation 64Cu with High Activity From Cu Phthalocyanin, Herr et al., 5a 629-630 (1950).
Measurement of Macrocopic and Microscopic Thermal Neutron Cross Sections of V, Co, Cu, In, Dy and Au Using Neutron Self-Absorption Properties Celenk et al., Journal of Radioanalytrical and Nuclear Chemistry, Articles, vol. 148, No. 2 (1991) 393-401.
R.J. Batra and A.N. Garg., "Thermal Neutron Activation Analysis of Cu In Its Ores by Using AN 2 4 1 Am—Be Neutron Source," Journal of Radioanalytical and Nuclear Chemistry, Articles, 129(2), pp. 335-342, 1989.
Rodger C. Martin and Steven E. Kos, "Applications and Availability of Californium-252 Neutron Sources for Waste Characterization," Presentation at Spectrum 2000 International Conference on Nuclear and Hazardous Waste Management, Chattanooga, Tennessee, Sep. 24-28, 2000.

* cited by examiner

COMPOSITION OF MATTER COMPRISING A RADIOISOTOPE COMPOSITION

CROSS REFERENCE TO RELATED APPLICATIONS

This is a divisional of U.S. patent application Ser. No. 12/887,933, filed Sep. 22, 2010, the contents of which are incorporated by reference.

FIELD OF INVENTION

This application is directed toward production and use of radioactive isotopes, or radioisotopes.

BACKGROUND

Radioactive isotopes have many beneficial uses. As one example, positron-emitting copper isotopes, such as copper-64 ($^{64}$Cu) and copper-60 ($^{60}$Cu) have a number of uses in clinical and pre-clinical nuclear medicine. These uses include, but are not limited to, the labeling of compounds and the creation of phantom objects suitable for localization and coregistration of multimodality imaging systems, such as those which combine magnetic resonance and positron-emission (MR-PET) imaging. In some instances these radioisotopes are used for oncology imaging and oncological therapy.

The production of radioisotopes is one of the factors that limit their use. Production may involve expensive starting materials, such as isotopically enriched substances, and expensive and time-consuming procedures using large, unmovable, and scarce equipment. If a desired radioisotope has a very short half-life it must be used very soon after it is made. This may not be possible unless the radioisotope is made at, or very close to, the location where it is to be used. It may not be economically or physically feasible, however, to have the necessary equipment at or near that location.

As an example, $^{64}$Cu is produced using either a cyclotron or a nuclear reactor, both of these being large, immobile machines with relatively high operating expenses. A starting material used is Nickel-64 ($^{64}$Ni), which is a rare isotope requiring expensive enrichment before being transformed into $^{64}$Cu. For the particular case of $^{64}$Cu, two methods are known for producing this isotope. In one method, $^{64}$Ni is bombarded with protons from a particle accelerator. A $^{64}$Ni nucleus absorbs a proton and emits a neutron and is thereby transmuted into a $^{64}$Cu nucleus. This series of reactions, also referred to as a channel, is designated $^{64}$Ni(p,n)$^{64}$Cu. In a second method, naturally occurring copper is bombarded with neutrons. A $^{63}$Cu nucleus absorbs a neutron and is thereby transmuted into $^{64}$Cu nucleus. The nucleus is created with excess energy, which it reduces by emitting gamma radiation immediately after the transmutation. This channel is designated $^{63}$Cu(n,$\gamma$)$^{64}$Cu.

In a variation known as the Szilard-Chalmers effect, a particular atom is a constituent of a molecule dissolved in a liquid. A nuclear reaction involving the nucleus of such atoms results in the nucleus emitting one or more gamma rays, causing a recoil effect in which the atoms, now each transformed into a radioisotope, are ejected from the molecules and into solution in the liquid. The radioisotope atoms may then be chemically or electrolytically extracted from the liquid.

SUMMARY

Disclosed are method and apparatus for making a radioisotope using a portable neutron source. A material comprising a particular isotope is obtained and exposed to neutrons from a portable neutron source, the particular isotope reacting with a neutron and transforming into the radioisotope.

DETAILED DESCRIPTION

Figure 1:
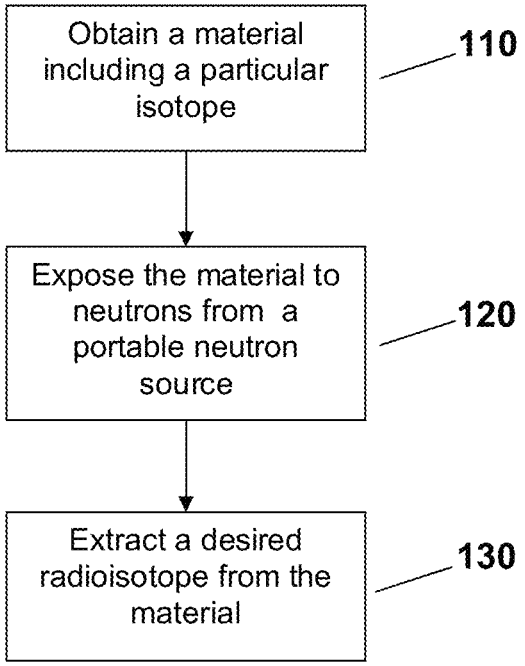
FIG. 1 shows a method for producing a radioisotope including a portable neutron source.

FIG. 1 shows a method of making a radioisotope. A material is obtained which includes a particular isotope which will be transformed into the radioisotope 110. The particular isotope may be present in its natural concentration—the method described here may not require initial enrichment. As an example, naturally occurring copper comprises 69% copper-63 ($^{63}$Cu) and 31% copper-65 ($^{65}$Cu). The particular isotope $^{63}$Cu, in this naturally occurring abundance, may be transformed, without being enriched, into $^{64}$Cu, as described below. The material may be a bulk solid or powdered solid containing the particular isotope. The material may be a pure liquid or a mixture of liquids containing the particular isotope. The material may be a solution of a compound containing the particular isotope, the compound being dissolved in a liquid, solid, or gas. The material may be a gas or vapor including the particular isotope or a mixture of gasses, at least one of which includes the particular isotope. The particular isotope may be a nucleus of a single atom or a nucleus of an atom bound in a molecule. Other appropriate configurations of matter may be considered by one of ordinary skill in the art without departing from the scope of the claims.

The material is exposed to neutrons from a portable neutron source 120. A portable neutron source is to be understood as a neutron source that is easily moved between different locations and that occupies a relatively small space, as distinct from, for example, a cyclotron or a nuclear reactor. Examples of known, commercially available portable neutron sources include plutonium-beryllium sources, americium-beryllium sources, deuterium-tritium neutron sources, and californium 252 ($^{252}$Cf) sources. In a deuterium-tritium source, deuterium gas is ionized, accelerated in an electrostatic field, and allowed to impact on a sealed tritium target, creating neutrons as a result of the t(d,n)$^{4}$He nuclear reaction. In an americium-beryllium source, alpha particles emitted by the americium react with beryllium nuclei, resulting in the emission of neutrons. A plutonium-beryllium source works in similar fashion with plutonium emitting the alpha particles. $^{252}$Cf undergoes spontaneous fission with the emission of a neutron. $^{252}$Cf neutron sources are available that emit a total flux of $10^{11}$ neutrons per second. Neutron sources can be fabricated in a large range of sizes including portable sizes as described above. For example, $^{252}$Cf neutron sources shaped as cylinders, including ones with outer diameter 5.5 mm and outside length 25 mm, are available from Frontier Technology Corporation, Xenia, Ohio.

The portable neutron source may be situated within the material. The portable neutron source may be completely surrounded by the material. Alternatively, at least a portion of the portable neutron source may be situated outside the material. Nuclei of the particular isotope react with neutrons from the portable neutron source 120 resulting in the particular isotope transforming into the desired radioisotope. The transformation may occur through any of several different reaction paths, or channels, such as those described below.

After the material has been exposed to the neutrons 120 for a time sufficient to produce a desired quantity of the radioisotope, the radioisotope may be extracted from the material 130. Extraction 130 may be carried out by, for example, chemical methods known to those of ordinary skill in the art for the particular element in question. Alternatively, the radioisotope may be left within the material. The material may then be used as a source of the radiation emitted by the radioisotope.

Figure 2:
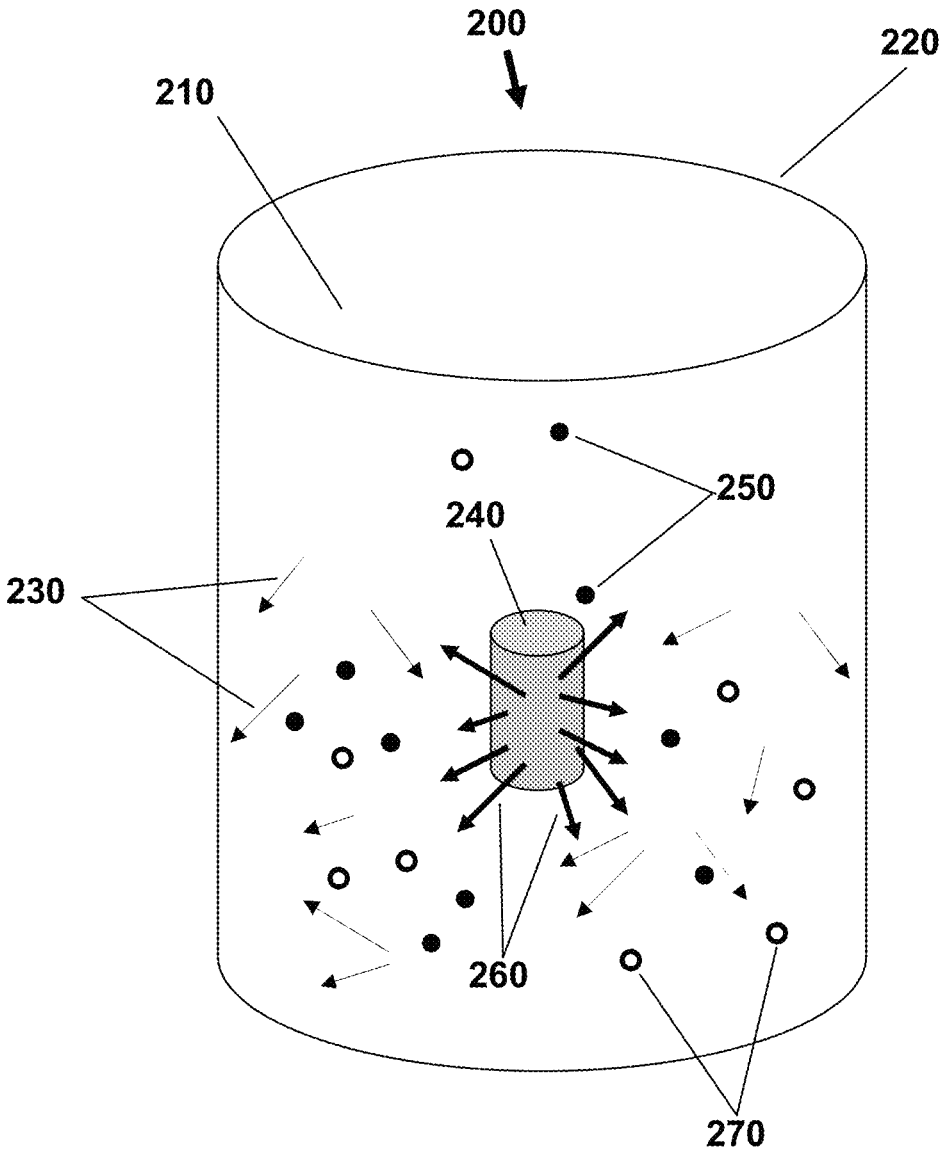
FIG. 2 shows an embodiment of an apparatus for producing a radioisotope including a portable neutron source.

FIG. 2 shows an embodiment of an apparatus 200 for producing a radioisotope using a portable neutron source 240 in proximity to a container 220. Container 220 contains a material 210 which includes a particular isotope 250. Portable neutron source 240 is shown completely surrounded by material 210. Alternatively, at least a portion of portable neutron source 240 may be situated outside material 210. Portable neutron source 240 emits neutrons 260 into material 210. Neutrons 260 emerging from portable neutron source 240 may have energies in excess of thermal energy of material 210, as depicted by thick arrows. These neutrons 260 are known as fast neutrons. Within a short distance of portable neutron source 240, several centimeters for example, fast neutrons 260 may slow down and come into thermal equilibrium with material 210 after undergoing many collisions with atoms or molecules in material 210. These slower neutrons 230, depicted by thin arrows, are known as thermalized neutrons or thermal neutrons.

Neutrons from portable neutron source 240, either fast neutrons 260 or thermal neutrons 230, may then react with the nuclei of a particular isotope 250, represented by filled-in circles, included in material 210. As a result, the nuclei of particular isotope 250 are transformed into nuclei of a desired radioisotope 270, represented by unfilled circles. Depending on neutron cross-sections and neutron reaction dynamics for particular isotope 250, either fast neutrons 260 or thermal neutrons 230 or both may contribute significantly to formation of radioisotope 270.

Material 210 may be a bulk solid or powdered solid containing particular isotope 250. Material 210 may be a pure liquid or a mixture of liquids containing particular isotope 250. Material 210 may be a solution of a compound, the compound containing particular isotope 250. The compound may be dissolved in a liquid, in a solid, or in a gas. Material 210 may be a gas or vapor including particular isotope 250 or a mixture of gasses, at least one of which includes particular isotope 250. Particular isotope 250 may be a nucleus of a single atom or a nucleus of an atom bound in a molecule. A portion of material 210 may act as a moderator that reduces energy of neutrons emitted from portable neutron source 240. Such moderated neutrons may be slowed down to energies less than energies with which they are emitted. The neutrons may be thermalized in this way. For example, if particular isotope 250 is in a water solution, the water may act as a moderator. Thus, portable neutron source 240 may be completely surrounded by both particular isotope 250 and by a moderator. This geometry is shown in the embodiment illustrated in FIG. 2. Other appropriate states of matter and other geometrical configurations may be considered by one of ordinary skill in the art without departing from the scope of the claims.

Once a desired amount of particular isotope 250 has been transformed into radioisotope 270, the latter may be separated from material 210 by, for example, chemical or physical methods known to those of ordinary skill in the art. As an example, if radioisotope 270 can be ionized in solution it may be separated by electroplating. Alternatively, the separation may be carried out using separate extraction apparatus known as a chemistry kit (not shown). The chemistry kit may be integral with apparatus 200. Alternatively, radioisotope 270 may be left within the material. The material may then be used as a source of the radiation emitted by the radioisotope.

As examples not to be considered limiting, the method, apparatus, and composition of matter described above may be applied to the production of the copper isotope $^{64}$Cu. In a particular embodiment, portable neutron source 240 may be a plutonium-beryllium (Pu—Be) source, an americium-beryllium (Am—Be) source, a deuterium-tritium (D—T) source, a $^{252}$Cf source, or another portable neutron source. Material 210 may be an aqueous solution of a copper-containing compound such as copper phthalocyanine, or copper salicylaldehyde o-phenylene diamine. The compound may contain copper isotopes in their natural abundances, which are 69% $^{63}$Cu and 31% $^{65}$Cu. The $^{63}$Cu may serve as particular isotope 250. Thermal neutrons 230 may react with the $^{63}$Cu particular isotopes 250 which transform into $^{64}$Cu as an example of formed radioisotope 270. In this embodiment the $^{64}$Cu radioisotope is produced by the $^{63}$Cu $(n,\gamma)^{64}$Cu reaction, in which a $^{63}$Cu nucleus absorbs a neutron to become $^{64}$Cu, emitting a $\gamma$ photon in the process. Experiments in which a copper-containing solid was bombarded with thermal neutrons have yielded about 50 nanoCuries of $^{64}$Cu. By using a stronger portable neutron source and a geometry such as that shown in FIG. 2, it is estimated that 100-1000 times as much $^{64}$Cu—that is to say a large number of microCuries—may be generated in this manner.

Materials including radioisotopes made using the method and apparatus described above may be shaped into objects with geometrical shapes such as markers, arrows, right-left designating shapes, text, and numbers. Such objects may be used in medical imaging for image registration, aligning, testing, and labeling. In particular, objects that include the positron-emitting isotope $^{64}$Cu may be useful in positron-emission tomography (PET) imaging.

Compared with currently known technologies for making radioisotopes, the method, apparatus, and composition of matter described above, making use of a portable neutron source, present possibilities for making radioisotopes less expensively with equipment taking up much less space. Also presented is the possibility of making radioisotopes with short half lives at the location where they are needed, such as a hospital. In this way, a larger number of useful radioisotopes may become available to a practitioner, such as a physician.

While the preceding description refers to certain embodiments, it should be recognized that the description is not limited to those embodiments. Rather, many modifications and variations may occur to a person of ordinary skill in the art which would not depart from the scope and spirit defined in the appended claims.

What is claimed is:

1. A composition of matter comprising a radioisotope composition, the radioisotope composition made according to a method comprising:

obtaining an aqueous solution comprising an isotope composition that comprises $^{63}$Cu and $^{65}$Cu isotopes, where the isotope composition comprises copper phthalocyanine or copper salicylaldehyde o-phenylene diamine;

placing the solution into a container;

exposing the aqueous solution to neutrons from a portable neutron source by completely surrounding the portable neutron source with the isotope composition, the isotope composition reacting with the neutrons and transforming into the radioisotope composition, where the radioisotope composition comprises $^{63}Cu$, $^{64}Cu$ and $^{65}Cu$ isotopes; and extracting the radioisotope composition from the aqueous solution when a desired amount of the $^{63}Cu$ isotope is converted to $^{64}Cu$ radioisotope.

2. The composition of claim 1, wherein the $^{64}Cu$ radioisotope is dispersed throughout a material.

3. The composition of claim 2, wherein the material has a geometrical shape.

* * * * *